US008418519B2

(12) United States Patent
Persson

(10) Patent No.: US 8,418,519 B2
(45) Date of Patent: Apr. 16, 2013

(54) HAND TOOL WITH ANTI-SLIP DEVICE

(75) Inventor: Lars-Olov Persson, Älvdalen (SE)

(73) Assignee: Pressmaster AB, Älvdalen (SE)

( * ) Notice: Subject to any disclaimer, the term of this patent is extended or adjusted under 35 U.S.C. 154(b) by 478 days.

(21) Appl. No.: 12/569,235

(22) Filed: Sep. 29, 2009

(65) Prior Publication Data

US 2010/0095737 A1 Apr. 22, 2010

(30) Foreign Application Priority Data

Oct. 21, 2008 (SE) ..... 0802241-0

(51) Int. Cl.
*B25B 7/00* (2006.01)
*B25G 1/10* (2006.01)

(52) U.S. Cl.
USPC ..... 72/409.01; 72/416; 81/427.5; 16/421

(58) Field of Classification Search ..... 72/409.01, 72/409.13, 412, 416, 466.6; 81/427.5; 16/421, 16/431, 435, 436; 29/282, 751
See application file for complete search history.

(56) References Cited

U.S. PATENT DOCUMENTS 4,353,240 A 10/1982 Undin et al.
5,105,648 A 4/1992 Steiner et al.
5,121,624 A * 6/1992 Haughian ..... 72/409.19
6,024,000 A 2/2000 Goldmann, II
6,270,134 B1 8/2001 Lin
2003/0126955 A1 7/2003 Hartranft et al.
2008/0078273 A1 4/2008 Steiner et al.
2009/0271951 A1 * 11/2009 Hao ..... 16/430

FOREIGN PATENT DOCUMENTS

DE 201 14 326 U1 7/2002
DE 203 11 975 U1 11/2003
DE 20 2004 019 156 U1 3/2005
EP 0 988 934 A2 3/2000

OTHER PUBLICATIONS

KNIPEXD-WERK, KNIPEX—Das Komplette, Zangen—Programm, Katalog 1992/93, 3 pages.

* cited by examiner

*Primary Examiner* — Debra Sullivan
(74) *Attorney, Agent, or Firm* — Dickstein Shapiro LLP

(57) ABSTRACT

The invention relates to a hand tool comprising handles and jaws, where the jaws are operated by the handles, and where an anti-slip device is arranged on the outer side of the distal end of a tool handle. The tool handle has a hard surface with low friction enabling the users fingers to slide on the surface of the handle when squeezing the handles together, and the anti-slip device is arranged to be supported against a support surface in order for the user to be able to press the tool handles together in a controlled manner using a force (F) in excess of hand force.

3 Claims, 3 Drawing Sheets

HAND TOOL WITH ANTI-SLIP DEVICE

FIELD OF THE INVENTION

The present invention relates to a hand tool.

BACKGROUND OF THE INVENTION AND RELATED ART

Hand tools may be used for e.g. cable termination when connecting a cable or a wire to power, coaxial, fiber-optic or modular connectors. Cable termination hand tools may comprise e.g. cutting tools, stripping tools and crimping tools. When crimping, a connector i.e. a terminal, splice, contact or a similar device is mechanically secured to a cable—e.g to a conductor such as a wire—by deformation so that a solid joint having reliable mechanical and electrical connection is formed. The crimping operation resulting in a crimped joint is e.g. performed using crimping dies.

Hand tools may comprise handles having a relatively soft surface, e.g. an outer covering, in order to increase the comfort in holding the tool when squeezing the handles together.

U.S. Pat. No. 6,024,000 A shows a symmetric hand tool with impact strength and wear resistance protection on handle ends arranged to protect the tool if the tool is dropped.

U.S. Pat. No. 6,270,134 B1 shows a symmetric hand tool having soft covering on handles.

U.S. Pat. No. 5,105,648 A shows an asymmetric hand tool having an easily grippable outer covering on both handles.

A drawback with such soft handles is that the friction between the users fingers and a moving handle increases compared to having the users fingers slide along a hard handle with lower friction, which makes it harder to press the handles together as the fingers will not slide on the handle surface as easily.

US 2008/0078273 shows a symmetric hand tool with polycarbonate handles.

A problem with the above hand tools is that if the force needed to press the handles of the hand tool together is very large such as may be the case when e.g. crimping a strong workpiece, even handles with low friction surfaces may be hard to press together using only the users hand force.

SUMMARY OF THE INVENTION

The primary object of the present invention is to provide an improved hand tool in order to be able to use force in excess of hand force to in a controlled manner press together the handles of a hand tool having at least one handle having a hard surface with low friction.

These and other advantageous features will be apparent from the detailed description below.

The invention will now be described in more detail below with reference to the appended drawings which illustrate preferred embodiments of the device according to the invention.

DESCRIPTION OF PREFERRED EMBODIMENTS

Figure 1:
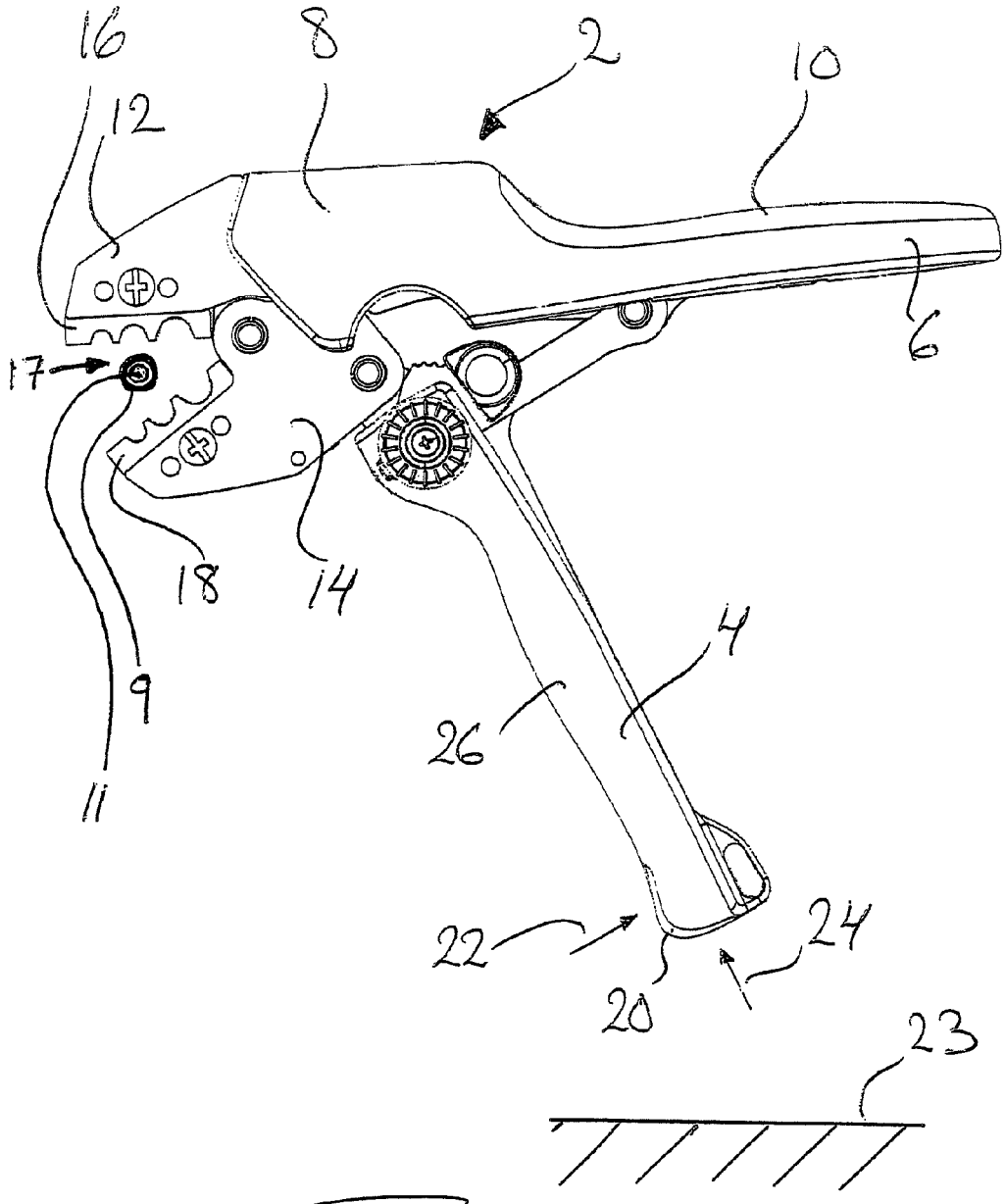
FIG. 1 shows schematically a side view of a asymmetric hand tool according to the invention in open position, i.e. before pressing the handles together.

The same reference numerals are being used for similar features in the different drawings.

FIG. 1 shows schematically a side view of an asymmetric hand tool 2, here depicted as a crimping tool, in an open position, i.e. before pressing the tool handles 4, 6 together. An asymmetric hand tool 2 is designed to be used and operated in a specific orientation, i.e. it has a first, lower, handle 4 and a second, upper, handle 6 as can be seen in the figure. The hand tool 2 shown also comprises a body 8 of e.g. metal. The first handle 4 and the second handle 6 are movable relative to another, i.e. pivotally interconnected by a mechanism (not shown). In this embodiment, the second handle 6 is integrated in the body 8 and has a non-slip covering 10 in order to have an anti-slip effect to the users palm and to minimize discomfort and cushion the users grip when squeezing the handles 4, 6 together. The second handle 6 may alternatively be movable relative to the body 8. The hand tool 2 further comprises jaws 12, 14, in this embodiment further comprising crimping dies 16, 18, movable relative to one another. The crimping dies 16, 18 arranged on the jaws 12, 14 are arranged to be brought together when the handles 4, 6 are pressed together in order to squeeze a workpiece 9 between the jaws 12, 14, in this embodiment to crimp a workpiece 9 between crimping dies 16, 18 arranged on the jaws 12, 14. Further, a return spring (not shown) may be arranged to press apart the first handle 4 from the second handle 6 when the users grip on the handles 4, 6 is released.

As mentioned above, the lower handle 4 which the users fingers grip when pressing the handles 4, 6 together should have a surface of low friction material in order for the users fingers to be able to slide on the handle surface as effortless as possible thus maximising the force of the users hand grip and the efficiency of the hand tool 2 when pressing the handles 4, 6 together using one hand. Even then, the force needed to press said handles 4, 6 together may sometimes be larger than the force of the users hand grip. In order to be able to press the handles 4, 6 together in such a situation, the hand tool 2 is arranged with an anti-slip device 20, at the outer side 22 of the distal end 24 of the lower handle 4, which anti-slip device 20 may be placed against a support surface 23 such as e.g. an upper surface of a table whereby the user may lean on the hand tool 2 thus applying body weight and a force F in excess of hand force on the upper handle 6 of the hand tool 2 via the users palm to press together the handles 4, 6 of the hand tool 2 in a controlled manner whereby the jaws 12, 14 of the hand tool 2 and in this embodiment thus also the crimping dies 16, 18 are pressed together using a force in excess of hand force without the risk of the hand tool 2 sliding and slipping unexpectedly and uncontrollably along the support surface 23.

The anti-slip device 20 is made of a high friction material such as e.g. rubber or softer plastic such as Santopren™, which material preferably is softer than the handle surface 26. If the lower handle 4 is e.g. is covered with or made of Nylon, the anti-slip device 20 may be made of e.g. rubber, and the surface 10 of the upper handle 6 may be coated with a thermoplastic elastomer such as e.g. Santopren™ in order to keep the palm of the users hand from slipping uncontrollably on the surface of the upper handle 6 while enabling the users fingers to slide on the surface of the lower handle 4 when squeezing the handles 4, 6 together. The lower handle 4 and the anti-slip device 20 are preferably molded together, but may also be glued together. In order to increase the comfort for the user without decreasing the force possible to apply on the handles 4, 6, the upper handle 6 may thus preferably comprise a softer material coating on at least its upper surface 10 or all over said handle 6 if the hand tool is asymmetric, i.e. has a specific upper handle 6 and a specific lower handle 4. If on the other hand the hand tool 2 is symmetric, i.e. may be used in any orientation, both handles 4, 6 should preferably have a low friction surface and comprise a distal anti-slip device 20 of the kind, and situated as, mentioned above.

Figure 2:
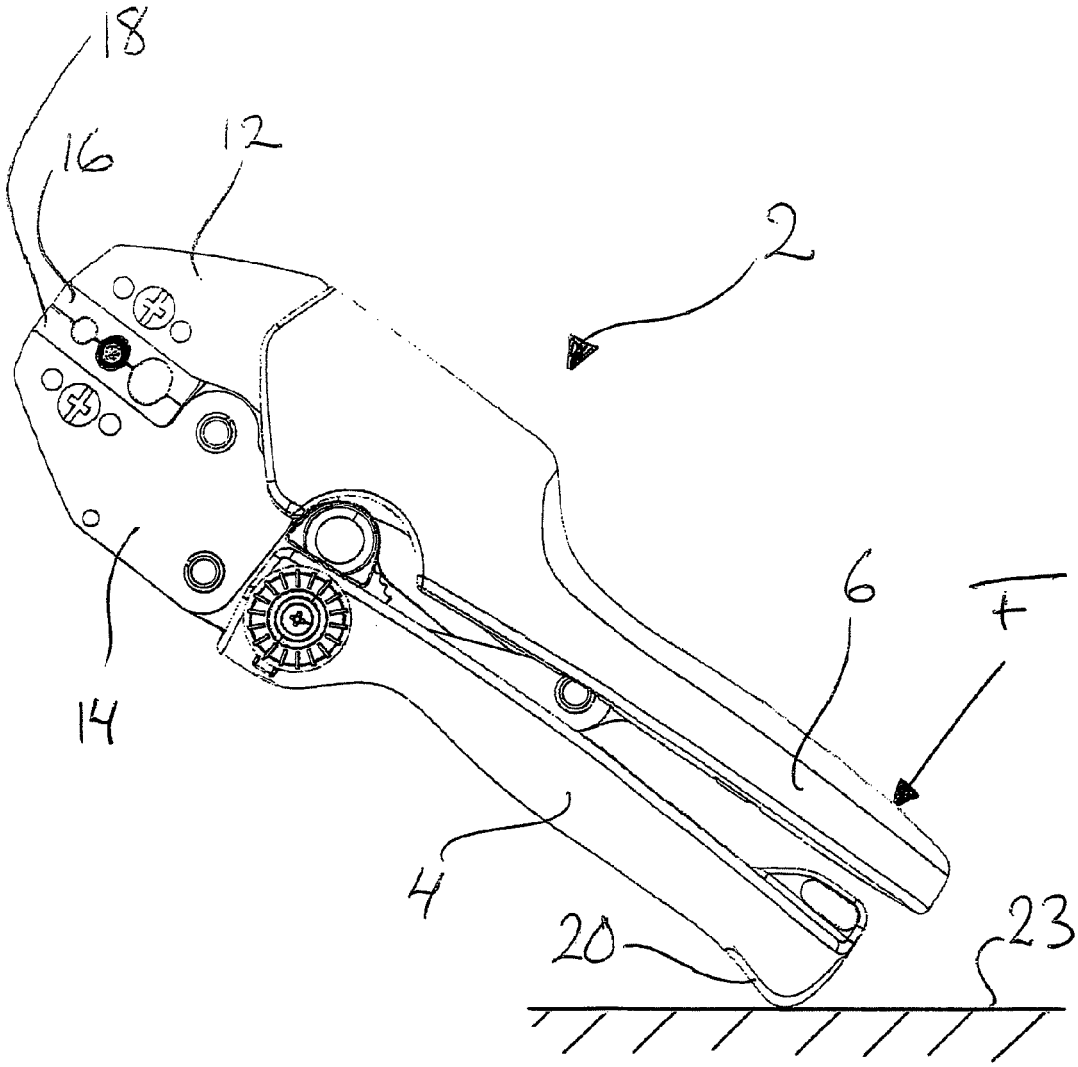
FIG. 2 shows schematically the asymmetric hand tool according to FIG. 1 in a closed position, i.e. after the handles have been pressed together.

FIG. 2 shows schematically the hand tool 2 according to FIG. 1 in a closed position, i.e. after the handles 4, 6 have been pressed together with the anti-slip device 20 at the distal end of the lower handle 4 abutting against a support surface 23 such as a table surface or the like in a position where a force F in excess of hand force may be applied on the upper handle 6 as mentioned above.

Figure 3:
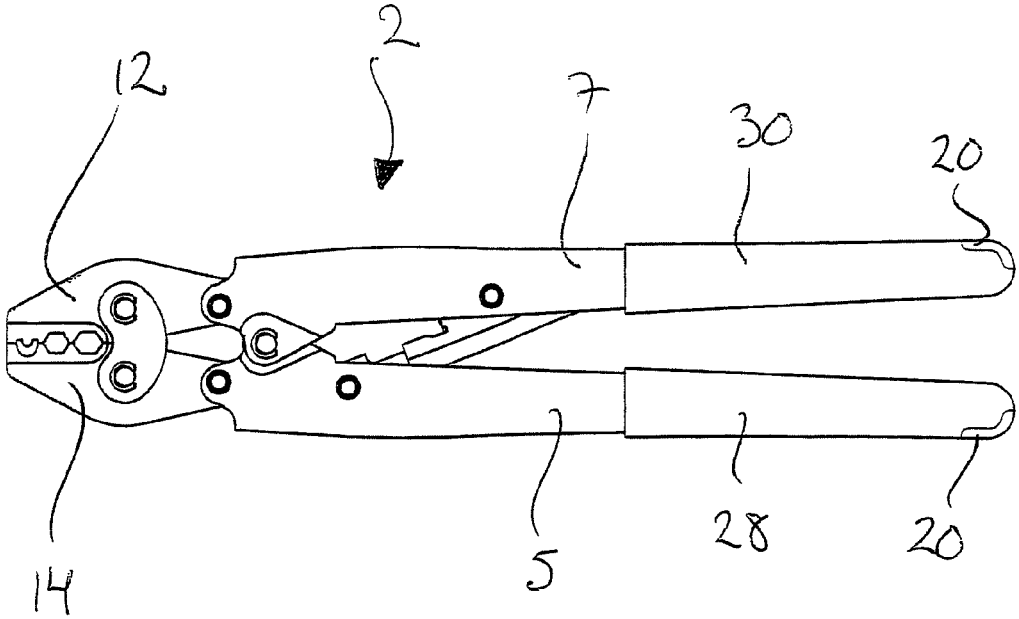
FIG. 3 shows schematically a symmetric hand tool according to the invention.

FIG. 3 shows schematically a symmetric hand tool 2 comprising two jaws 12, 14 and two movable handles 5, 7, each handle 5, 7 having a low friction surface 28, 30 and comprising a distal anti-slip device 20 of the above mentioned kind.

The operation of the hand tool 2 will now be described referring to FIG. 1 and using a crimping tool 2 as an example, as a crimping tool 2 is one of the more advanced kinds of hand tools.

Now referring to the tool described in FIG. 1, a crimping tool 2 according to the invention operates in the following manner:

Firstly, a workpiece 9 to be crimped such as a connector or a similar device is inserted into the opening 17 delimited by the crimping dies 16, 18.

After insertion of the workpiece 9, the crimping tool 2 is operated by gently squeezing the handles 4, 6 together making the jaws 12, 14 and thus the crimping dies 16,18 move slightly against each other thereby coming into contact with and exerting pressure on the workpiece 9 to be crimped so that the workpiece 9 to be crimped is held in place without being deformed. This enables easy insertion of a cable 11, e.g. a stripped portion of a wire, into the workpiece 9 to be crimped.

When the workpiece 9 and the cable 11 are aligned in a satisfactory way, the handles 4,6 are further squeezed together which makes the crimping dies 16,18 move further against each other. The handles are preferably dimensioned in order for a person using the crimping tool 2 to utilize the optimum gripping range of the hand that is about to exert a large force on the handles 4, 6 in order to bring them further together for the crimping of the workpiece 9. Changeable dies 16, 18 with dimensions depending on the dimension of the workpiece 9 to be crimped are preferably arranged in the hand tool 2. The optimum gripping range referred to above refers to the range of positions of the palm and the fingers of the hand where the hand and the fingers may exert the maximum force when the hand is clenched further together. This optimum gripping range is to be found in tables known in the art (see e.g. the article "Grip force Vectors for Varying Handle Diameters and Hand Sizes", HUMAN FACTORS, Vol. 46, No. 2, Summer 2004, pp 244-251, Human factors and Ergonomics Society).

When the handles 4, 6 are brought further together, this results in a crimped joint, in this embodiment with a substantially circular cross-section, with the workpiece 9 crimped about the cable 11.

If the crimping requires a large force, the user may lean on the upper handle 6 using body weight thus exerting an increased force F on the jaws 12, 14 and thus on the crimping dies 16, 18 as the lower handle 4 is arranged with an anti-slip device 20 as described above and in FIG. 2.

Finally the handles 4, 6 are released which in turn moves the jaws 12, 14 and thus the crimping dies 16,18 apart thereby allowing removal of the crimped connector 9 from the crimping tool 2.

What is claimed is:

1. A hand tool comprising first and second handles and jaws, where the jaws are operated by squeezing the handles together, wherein an anti-slip device is arranged on the outer side of a distal end of the first tool handle, the first tool handle has a hard surface with low friction enabling the user's fingers to slide on the surface of the first tool handle, and the anti-slip device is arranged to bear on a support surface in order for a user, with the use of one hand, to be able to press the second tool handle against the first tool handle in a controlled manner using a force (F) in excess of hand force; and wherein the anti-slip device is made of a high friction material;

wherein the hand tool further comprises crimping dies movable relative to one another and arranged on the jaws, the crimping dies being arranged to be brought together when the handles are pressed together in order to crimp a workpiece between the dies;

wherein the hand tool further comprises a body, and wherein the first handle is a lower handle which the user's fingers grip when pressing the handles together, the lower handle comprises the anti-slip device and the hard surface with low friction in order for the fingers to be able to slide on the handle surface as effortless as possible, thus maximizing the force of the user's hand grip and the efficiency of the hand tool when pressing the handles together using one hand, and the second handle is an upper handle and the second handle is integrated to the body;

wherein the upper handle has a non-slip covering in order to have an anti-slip effect to the user's palm and to minimize discomfort and cushion the user's grip when squeezing the lower and upper handles together; and wherein the handles are not symmetric with respect to each other, the lower handle has a length, and at least a portion of the anti-slip device at the outer side of the distal end is spaced apart from the jaws by at least the length of the lower handle, the anti-slip device is softer than the hard surface of the lower handle, and the hard surface of the lower handle provides less friction than the non-slip covering of the upper handle.

2. A hand tool according to claim 1, wherein the anti-slip device is made of rubber.

3. A hand tool according to claim 1, wherein the lower handle is covered with or made of nylon, and the surface of the upper handle is coated with a thermoplastic elastomer.

* * * * *